US012351971B2

(12) United States Patent
Leibman et al.

(10) Patent No.: US 12,351,971 B2
(45) Date of Patent: Jul. 8, 2025

(54) FLEXIBLE COVER MEMBER FOR AN APPLIANCE

(71) Applicant: Haier US Appliance Solutions, Inc., Wilmington, DE (US)

(72) Inventors: Alexander B. Leibman, Prospect, KY (US); V V Anil Bhaskar Prasad Seereddy, Hyderabad (IN); Venkata Chakradhar Rangu, Hyderabad (IN); Aaron Daniel Abbott, Louisville, KY (US); Byron James Dollar, Louisville, KY (US); James Conrad Nickell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1008 days.

(21) Appl. No.: 17/162,154

(22) Filed: Jan. 29, 2021

(65) Prior Publication Data

US 2022/0243385 A1 Aug. 4, 2022

(51) Int. Cl.

| | |
|---|---|
| ***D06F 39/14*** | (2006.01) |
| ***D06F 23/04*** | (2006.01) |
| ***D06F 58/20*** | (2006.01) |

(52) U.S. Cl.

CPC ..... *D06F 39/14* (2013.01); *D06F 23/04* (2013.01); *D06F 58/20* (2013.01)

(58) Field of Classification Search

CPC ..... A47L 15/4257; F26B 25/12; F24B 1/192

See application file for complete search history.

(56) References Cited

U.S. PATENT DOCUMENTS

| | | | | |
|---|---|---|---|---|
| 3,398,779 | A | 8/1968 | Kuss | |
| 3,421,568 | A | 1/1969 | Youngs | |
| 3,643,792 | A * | 2/1972 | Resener | B65G 17/066 198/852 |
| 3,865,229 | A * | 2/1975 | Velander | B65G 17/086 198/840 |
| 5,139,074 | A | 8/1992 | Warner | |
| 5,445,209 | A | 8/1995 | Lichy | |
| 5,482,104 | A | 1/1996 | Lichy | |
| 6,478,070 | B2 | 11/2002 | Poppema | |
| 6,757,160 | B2 | 6/2004 | Kevin | |
| 6,983,565 | B2 | 1/2006 | Berry | |
| 7,516,770 | B2 | 4/2009 | Jerry | |

(Continued)

FOREIGN PATENT DOCUMENTS

| | | | |
|---|---|---|---|
| CN | 101058931 | A | 10/2007 |
| CN | 202831525 | U * | 3/2013 |

(Continued)

*Primary Examiner* — Jason Lau

(74) *Attorney, Agent, or Firm* — Dority & Manning, P.A.

(57) ABSTRACT

The present disclosure is directed to an appliance having at least one chamber accessible via an opening and a flexible cover member for providing selective access to the opening. The flexible cover member includes a plurality of elongated rib members and a flexible skin covering surrounding the plurality of elongated rib members. The plurality of elongated rib members are aligned in a side-by-side configuration and secured together in a spatially consecutive arrangement. Further, the flexible cover member is movable between a flat, closed position that covers the opening and a curved, open position that exposes the opening.

16 Claims, 8 Drawing Sheets

(56) References Cited

U.S. PATENT DOCUMENTS

| | | | | |
|---|---|---|---|---|
| 8,336,258 | B2 | 12/2012 | Dervarics | |
| 8,429,929 | B2 | 4/2013 | Aragon | |
| 8,484,899 | B2 | 7/2013 | Dervarics | |
| 8,701,346 | B2 | 4/2014 | Marsh | |
| 2012/0111066 | A1* | 5/2012 | Hayashi | D06F 58/203 68/19 |
| 2018/0245265 | A1* | 8/2018 | Beres | D06F 33/34 |
| 2021/0054904 | A1* | 2/2021 | Tamura | F16G 1/28 |

FOREIGN PATENT DOCUMENTS

| | | | |
|---|---|---|---|
| EP | 0320350 | B1 | 3/1992 |
| EP | 2598708 | B1 | 8/2015 |
| JP | 2005205087 | A | 8/2005 |
| JP | 2005204970 | A | 6/2006 |
| JP | 2006136456 | A | 6/2006 |
| RU | 2377380 | C2 | 12/2009 |
| WO | WO-2017117892 | A1 * | 7/2017 |

* cited by examiner

FLEXIBLE COVER MEMBER FOR AN APPLIANCE

FIELD OF THE INVENTION

The present subject matter relates generally to appliances and more particularly to a flexible cover member for providing selective access to an opening of an appliance.

BACKGROUND OF THE INVENTION

Washing machine appliances generally include a tub for containing wash fluid, e.g., water, detergent, and/or bleach. A basket is rotatably mounted within the tub and defines a wash chamber for receipt of articles for washing. During operation of such washing machine appliances, wash fluid is directed into the tub and onto articles within the wash chamber of the basket. The basket can rotate at various speeds to agitate articles within the wash chamber in the wash fluid, to wring wash fluid from articles within the wash chamber, etc. For example, during operation of certain washing machine appliances, a spin cycle is performed to wring wash fluid from the articles within the wash chamber. The spin cycle typically entails rotating the basket at a relatively high rate of speed for a period of time. Typically, and desirably, the tub is generally empty of wash fluid and suds (caused by interaction between water and detergent, etc.). Washing machine appliances also typically include a rigid top lid (or rigid front door) for securing the articles within the wash chamber and for preventing the articles, as well as the water and detergent, from exiting the wash chamber during operation. Such appliances may also include various other compartments or chambers having various rigid doors or lids for providing selective access thereto.

Accordingly, the art is continuously seeking new and improved washing machine appliances. Thus, the present disclosure is directed to an appliance, such as a washing machine appliance, having a flexible cover member (rather than the rigid lid or door) for providing selective access to an opening of an appliance.

BRIEF DESCRIPTION OF THE INVENTION

Aspects and advantages of the invention will be set forth in part in the following description, or may be obvious from the description, or may be learned through practice of the invention.

In one aspect, the present disclosure is directed to an appliance. The appliance includes at least one chamber accessible via an opening and a flexible cover member for providing selective access to the opening. The flexible cover member includes a plurality of elongated rib members and a flexible skin covering surrounding the plurality of elongated rib members. The plurality of elongated rib members are aligned in a side-by-side configuration and secured together in a spatially consecutive arrangement. Further, the flexible cover member is movable between a flat, closed position that covers the opening and a curved, open position that exposes the opening.

In another aspect, the present disclosure is directed to a washing machine appliance. The washing machine appliance includes a tub, a basket rotatably mounted within the tub, the basket defining a chamber for receipt of articles for washing, a valve, a spout configured for directing fluid from the valve into the tub, a dispenser configured for dispensing detergent into the tub, a motor in mechanical communication with the basket, and a flexible cover member for providing selective access to the chamber. The motor is configured for selectively rotating the basket within the tub. The flexible cover member includes a plurality of elongated rib members and a flexible skin covering surrounding the plurality of elongated rib members. The plurality of elongated rib members are aligned in a side-by-side configuration and secured together in a spatially consecutive arrangement. Further, the flexible cover member is movable between a flat, closed position that covers the opening and a curved, open position that exposes the opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
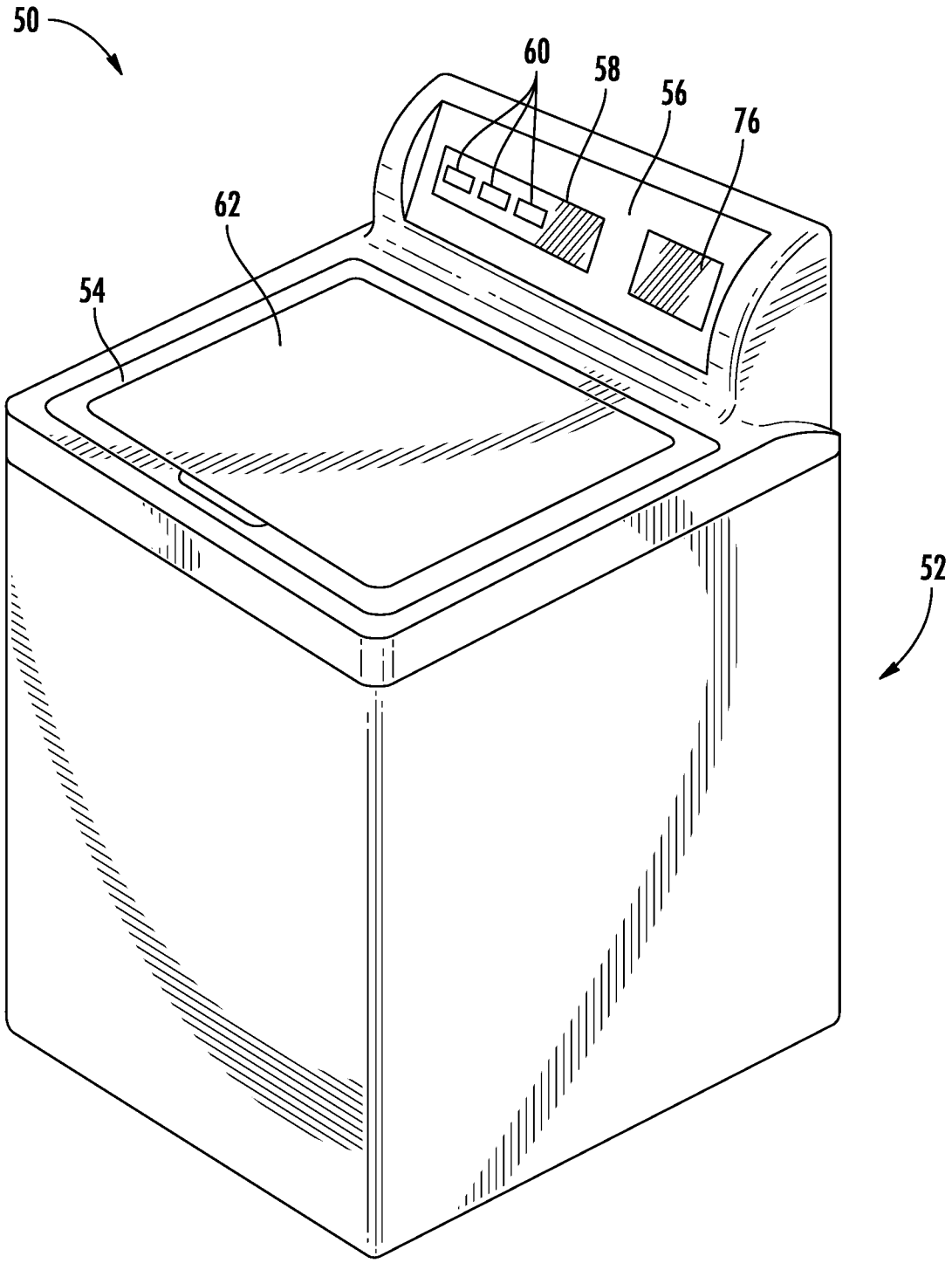
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 illustrates a perspective view of a washing machine appliance 50 according to an exemplary embodiment of the present subject matter. As may be seen in FIG. 1, the washing machine appliance 50 includes a cabinet 52 and a cover 54. A backsplash 56 extends from the cover 54, and a control panel 58 including a plurality of input selectors 60 is coupled to backsplash 56. The control panel 58 and input selectors 60 collectively form a user interface input for operator selection of machine cycles and features, and in one embodiment, a display 76 indicates selected features, a countdown timer, and/or other items of interest to machine users. A lid 62 is mounted to the cover 54 and is rotatable between an open position (not shown) facilitating access to a wash tub 64 (FIG. 2) located within the cabinet 52 and a closed position (shown in FIG. 1) forming an enclosure over the tub 64.

Figure 2:
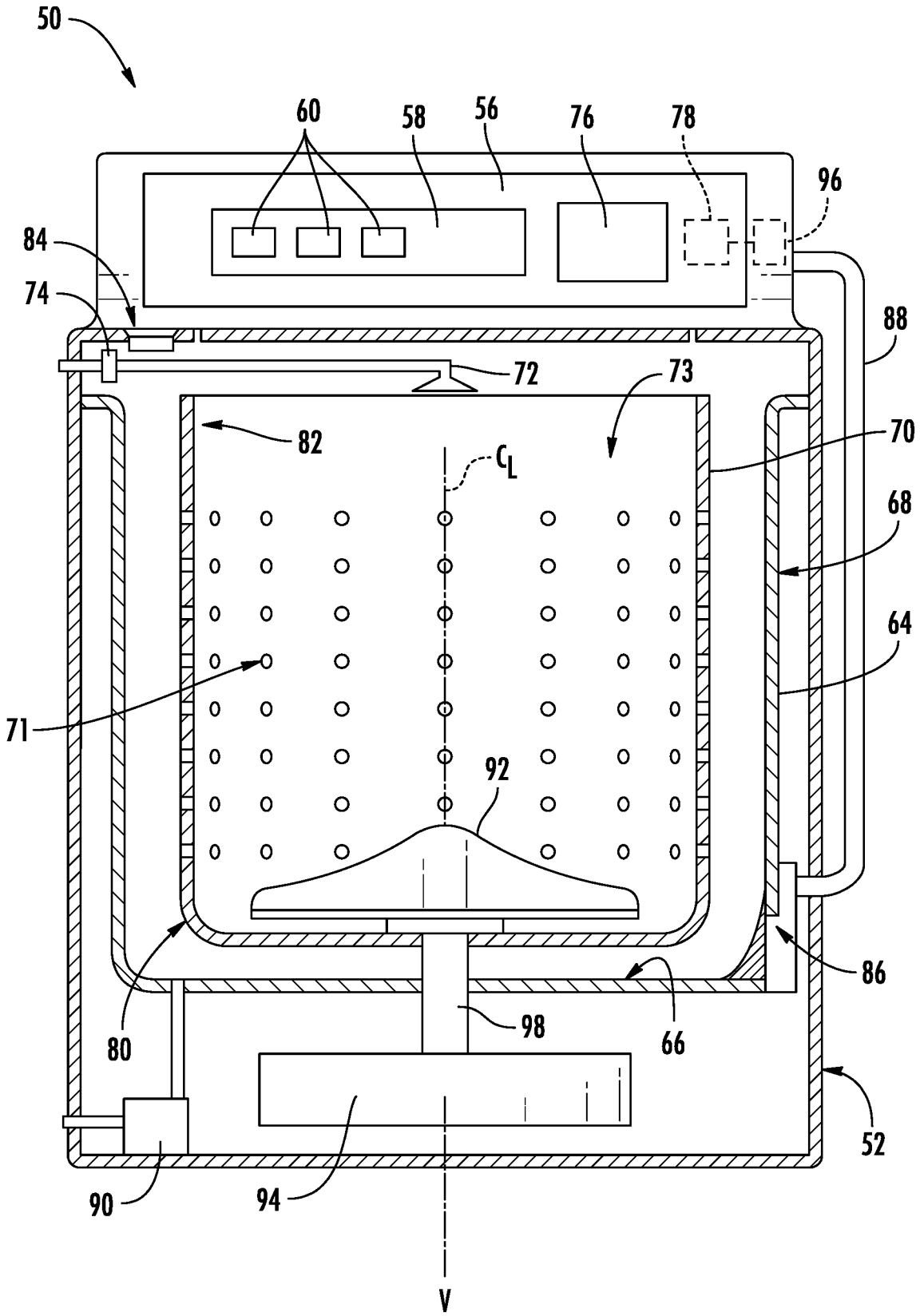
FIG. 2 provides a front, cross-sectional view of the exemplary washing machine appliance of FIG. 1.
Figure 3:
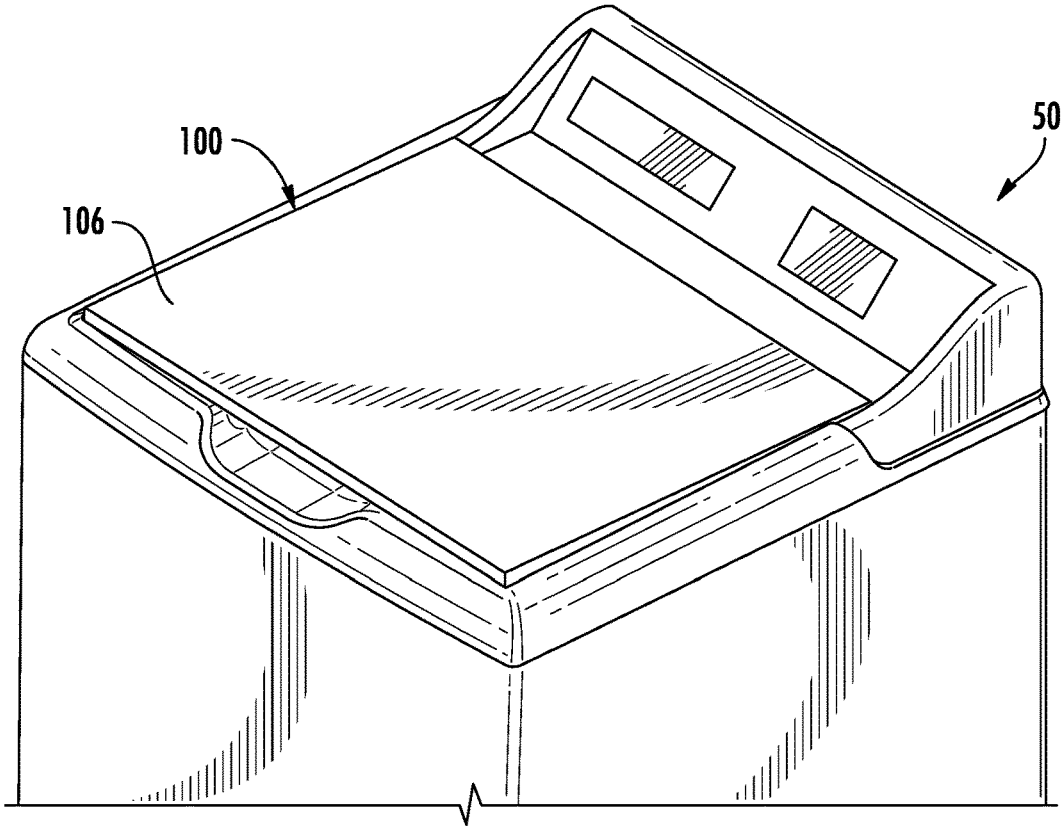
FIG. 3 provides a perspective view of an embodiment of a flexible cover member of an appliance according to the present disclosure, particularly illustrating the flexible cover member in a closed position.
Figure 4:
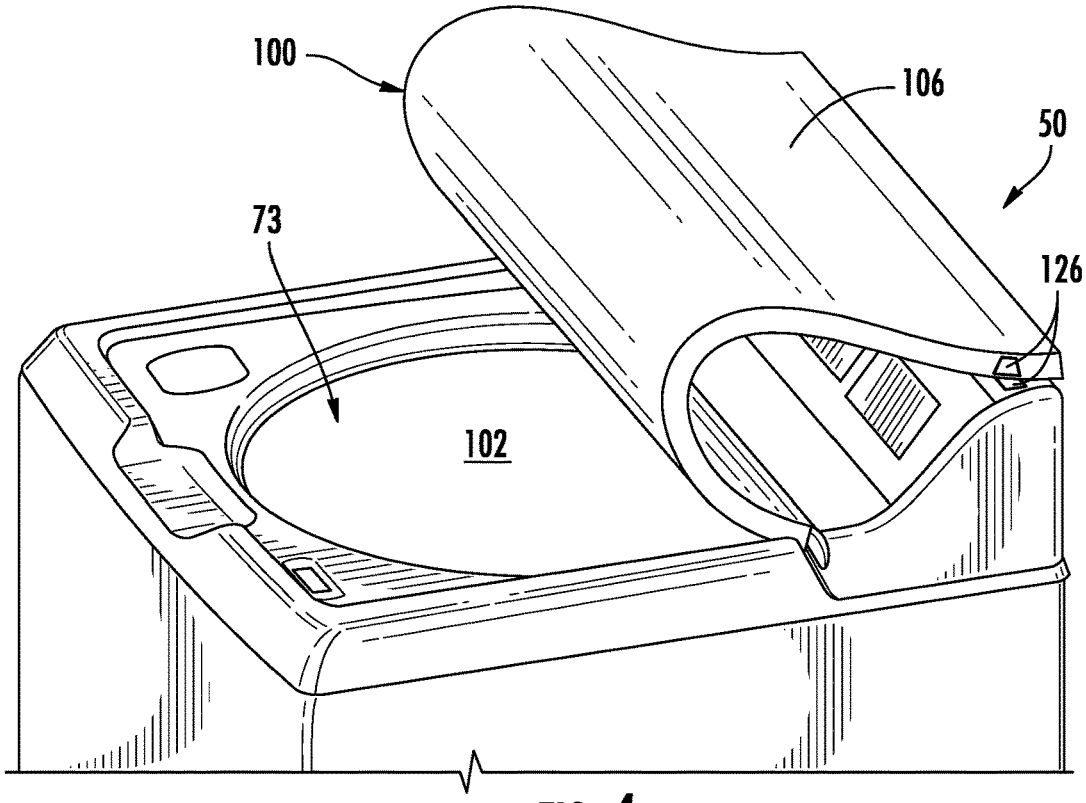
FIG. 4 provides a perspective view of an embodiment of a flexible cover member of an appliance according to the present disclosure, particularly illustrating the flexible cover member in an open position.

Referring now to FIG. 2, a front, cross-sectional view of the washing machine appliance 50 is illustrated. As may be seen in FIG. 2, the tub 64 includes a bottom wall 66 and a sidewall 68. A wash basket or wash drum 70 is rotatably mounted within the tub 64. In exemplary embodiments as shown, the basket 70 is rotatable about a vertical axis V. Thus, the washing machine appliance 50 in these embodiments is generally referred to as a vertical axis washing machine appliance. Further, as shown, the basket 70 defines a wash chamber 73 for receipt of articles for washing and extends, e.g., vertically, between a bottom portion 80 and a top portion 82. The basket 70 includes a plurality of openings or perforations 71 therein to facilitate fluid communication between an interior of the basket 70 and the tub 64.

A spout 72 is configured for directing a flow of fluid into the tub 64. In particular, the spout 72 may be positioned at or adjacent to the top portion 82 of the basket 70. The spout 72 may be in fluid communication with a water supply (not shown) in order to direct fluid (e.g., liquid water) into the tub 64 and/or onto articles within the chamber 73 of the basket 70. A valve 74 regulates the flow of fluid through the spout 72. For example, the valve 74 can selectively adjust to a closed position in order to terminate or obstruct the flow of fluid through the spout 72. A pump assembly 90 (shown schematically in FIG. 2) is located beneath the tub 64 and the basket 70 for gravity assisted flow to drain the tub 64.

Still referring to FIG. 2, an agitation element 92, shown as an impeller in FIG. 2, is disposed in the basket 70 to impart an oscillatory motion to articles and liquid in the chamber 73 of the basket 70. In various embodiments, the agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, the agitation element 92 is oriented to rotate about vertical axis V. The basket 70 and the agitation element 92 are driven by a pancake motor 94. Thus, as a motor output shaft 98 is rotated, the basket 70 and the agitation element 92 are operated for rotatable movement within the tub 64, e.g., about vertical axis V. Further, the washing machine appliance 50 may also include a brake assembly (not shown) selectively applied or released for respectively maintaining the basket 70 in a stationary position within the tub 64 or for allowing the basket 70 to spin within the tub 64.

Operation of the washing machine appliance 50 is controlled by a processing device or controller 78, that is operatively coupled to the user interface input located on washing machine backsplash 56 (shown in FIG. 1) for user manipulation to select washing machine cycles and features. As such, in response to user manipulation of the user interface input, the controller 78 operates the various components of the washing machine appliance 50 to execute selected machine cycles and features.

The controller 78 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 78 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 78 via one or more signal lines or shared communication busses.

In an illustrative embodiment, laundry items are loaded into the chamber 73 of the basket 70, and washing operation is initiated through operator manipulation of control input selectors 60. The tub 64 is filled with water and mixed with detergent to form a wash fluid. The valve 74 can be opened to initiate a flow of water into the tub 64 via the spout 72, and the tub 64 can be filled to the appropriate level for the number of articles being washed. In certain embodiments, the detergent may be poured directly into the basket 70 via a user. In alternative embodiments, the washing machine appliance 50 may be further equipped with a detergent dispenser 84 (FIG. 2) in which the detergent may be poured. In certain embodiments, as an example, the dispenser 84 may be a smart dispenser than can be controlled via the controller 78 as further described herein. Once the tub 64 is properly filled with wash fluid, the contents of the basket 70 are agitated with the agitation element 92 for cleaning of laundry items in the basket 70. More specifically, the agitation element 92 is moved back and forth in an oscillatory motion.

After the agitation phase of the wash cycle is completed, the tub 64 is drained. Laundry articles can then be rinsed by again adding fluid to the tub 64, depending on the particulars of the cleaning cycle selected by a user, the agitation element 92 may again provide agitation within the basket 70. One or more spin cycles may also be used. In particular, a spin cycle may be applied after the wash cycle and/or after the rinse cycle in order to wring wash fluid from the articles being washed. During a spin cycle, the basket 70 is rotated at relatively high speeds.

While described in the context of a specific embodiment of the washing machine appliance 50, using the teachings disclosed herein it will be understood that the washing machine appliance 50 is provided by way of example only. Other washing machine appliances having different configurations (such as horizontal-axis washing machine appliances), different appearances, and/or different features may also be utilized with the present subject matter as well.

Referring still to FIG. 2, a pressure chamber 86 may be defined in the tub 64. The pressure chamber 86 may be provided for facilitating tub pressure measurements. For example, a hose 88 may connect the pressure chamber 86 to a pressure sensor 96. The pressure sensor 96 may measure the pressure in the pressure chamber 86 or at another suitable location within the tub 64, and may be in operative communication with the controller 78. The pressure sensor 96 may be a component of the controller 78, or may be a separate component from the controller 78 which is in communication with the controller 78 through a suitable wired or wireless connection. The pressure sensor 96 may, for example, be an analog pressure sensor, a digital pressure sensor, a mechanical pressure switch, or any other suitable device capable of measuring pressure as required herein.

Referring now to FIGS. 3-14, various embodiments of a flexible cover member 100 for an appliance, such as washing machine appliance 50, are illustrated according to the present disclosure. In particular, as shown in FIGS. 3-6 and 9, the flexible cover member 100 can be used in place of lid 62. Thus, in the illustrated embodiment of FIGS. 3-6 and 9, the flexible cover member 100 is configured to provide selective access to the wash chamber 73 by exposing an opening 102 of the wash chamber 73. More particularly, the flexible cover member 100 is movable between a flat, closed position (FIG. 3) that covers the opening 102 and a curved, open position (FIGS. 4 and 5) that exposes the opening 102.

In certain embodiments, as shown particularly in FIGS. 5-8, the flexible cover member 100 includes a plurality of elongated rib members 104 and a flexible skin covering 106 surrounding the plurality of elongated rib members 104. Furthermore, as shown, the elongated rib members 104 are aligned in a side-by-side configuration and are secured together in a spatially consecutive arrangement. In particular embodiments, the elongated rib members 104 may be constructed from any suitable flexible material, such as glass-filled polypropylene (PP). In further embodiments, the elongated rib members 104 may include any other material having the desired strength and/or stiffness. Moreover, as shown particularly in FIGS. 7 and 8 and in certain embodiments, adjacent elongated rib members 104 of the plurality of elongated rib members may be secured together at respective adjoining ends 108, 110, e.g., via a snap fit. For example, as shown in the illustrated embodiment, the respective adjoining ends 108, 110 may include a joint 112, such as a ball joint or a dovetail joint.

In particular embodiments, the flexible skin covering 106 may be constructed of any suitable polymer material, such as a thermoplastic material, which can include rubber or silicone. For example, in certain embodiments, the flexible skin covering 106 may be formed of thermoplastic elastomer (TPE) or thermoplastic vulcanizate (TPV), which can bond chemically with the underlying material used to form the elongated rib members 104 (e.g., PP).

Figure 5:
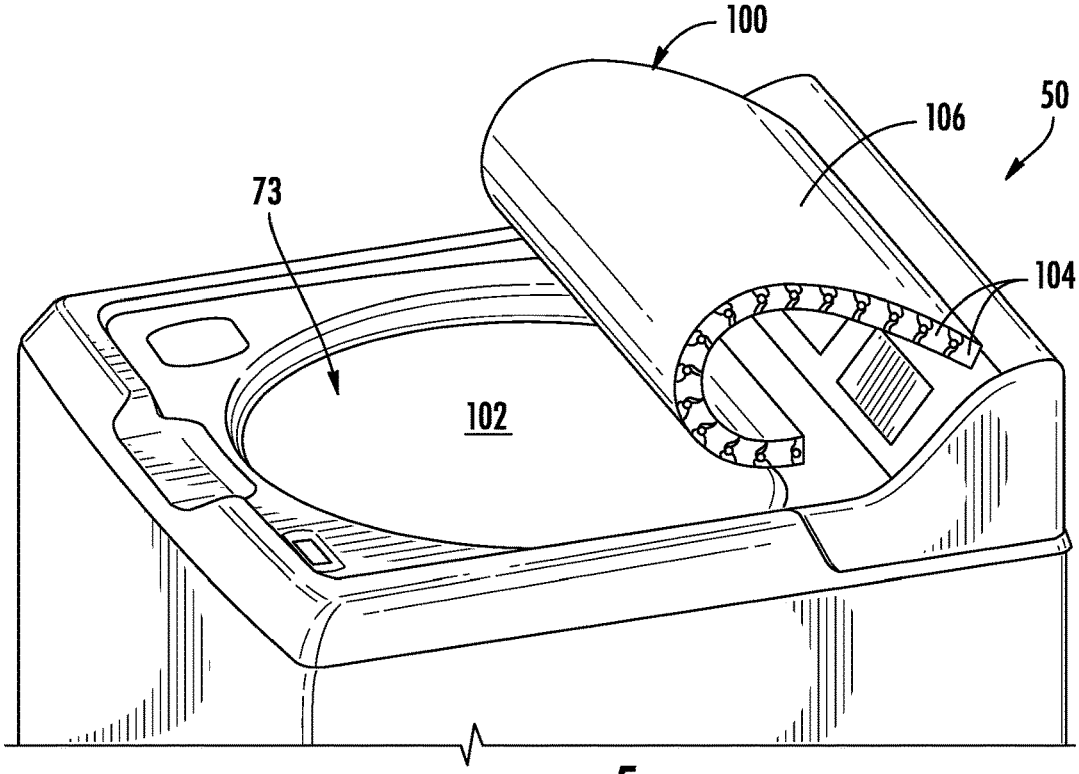
FIG. 5 provides a perspective view of the flexible cover member of FIG. 4, particularly illustrating part of a flexible skin covering removed therefrom to illustrate internal components thereof.
Figure 6:
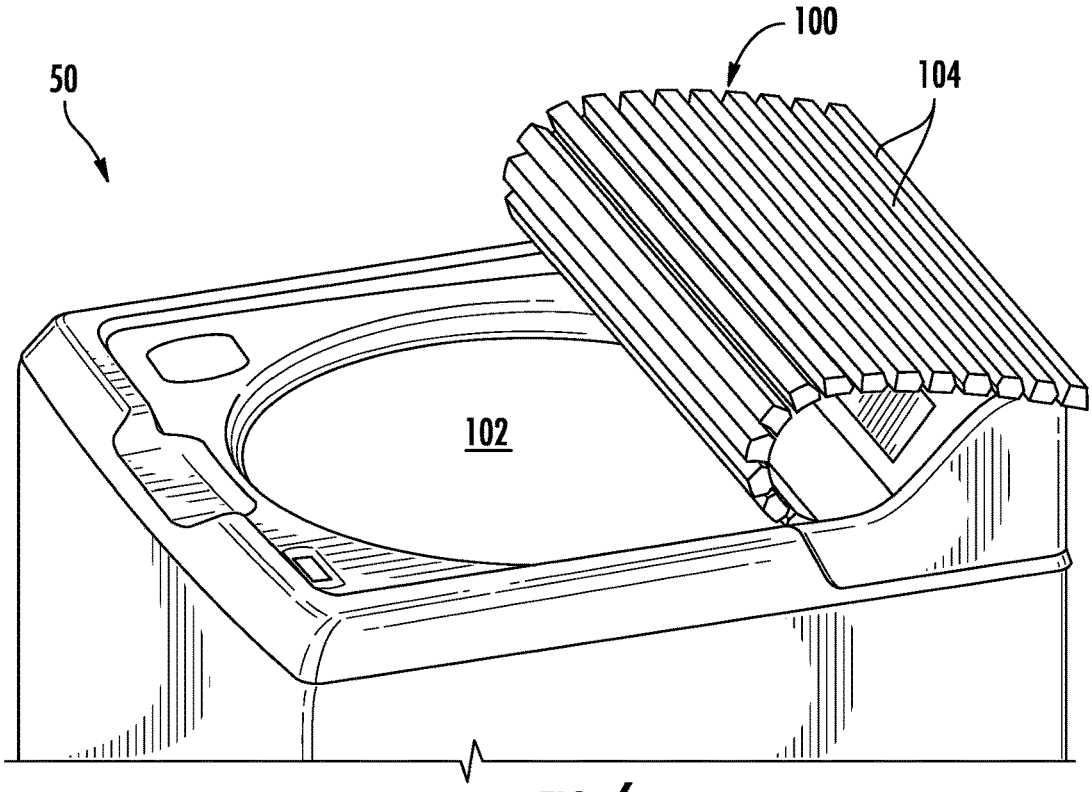
FIG. 6 provides a perspective view of an embodiment of a flexible cover member of an appliance according to the present disclosure, particularly illustrating the flexible cover member in an open position with the flexible skin covering removed to illustrate the plurality of elongated rib members thereof.
Figure 7:
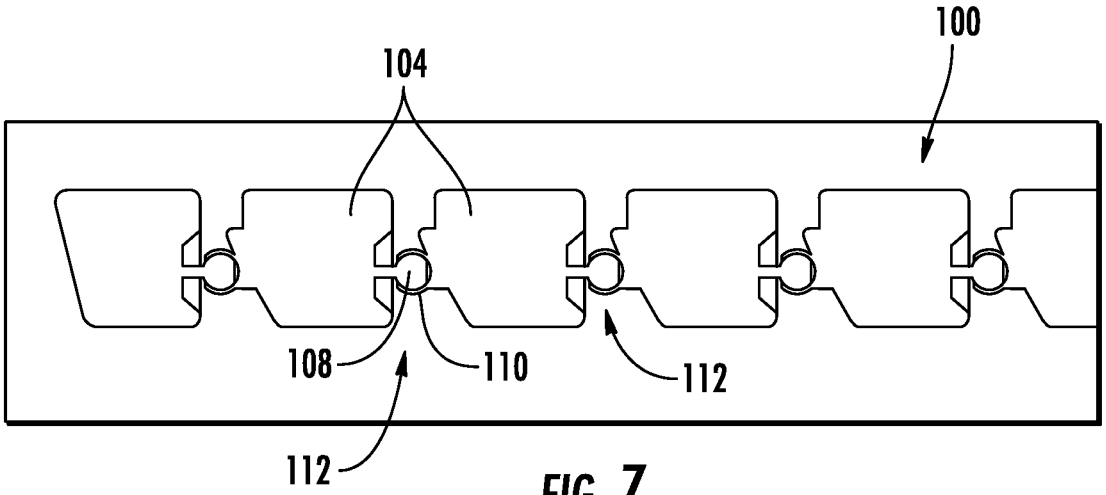
FIG. 7 provides a cross-sectional view of an embodiment of a plurality of elongated rib members of a flexible cover member of an appliance according to the present disclosure.
Figure 8:
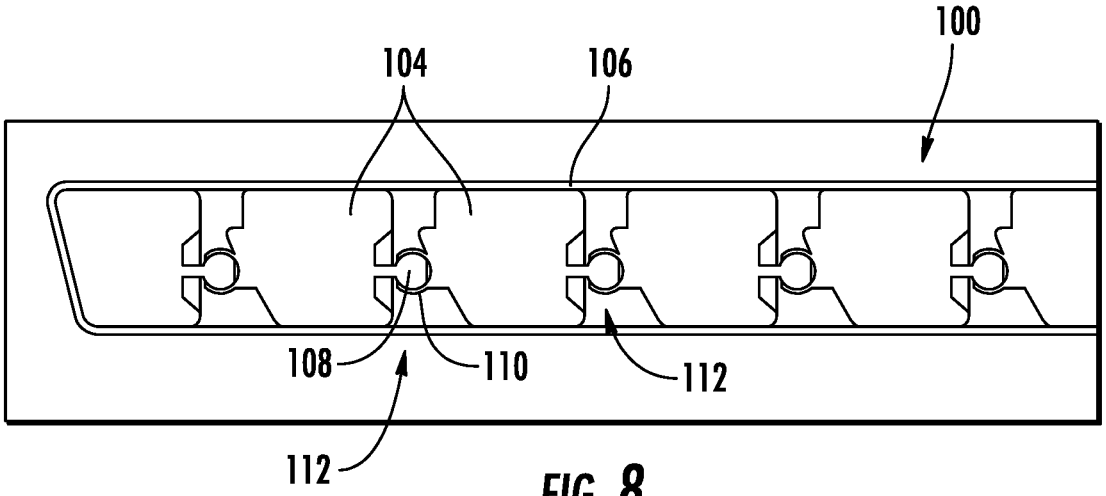
FIG. 8 provides a cross-sectional view of an embodiment of a plurality of elongated rib members encased with a flexible skin covering of a flexible cover member of an appliance according to the present disclosure.
Figure 9:
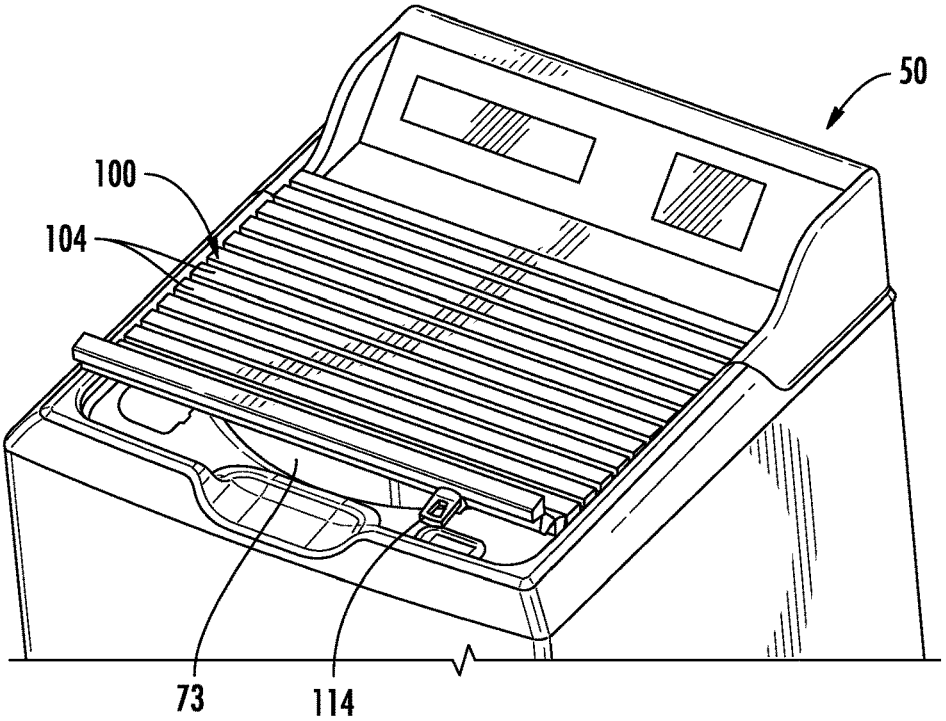
FIG. 9 provides a perspective view of an embodiment of a flexible cover member of an appliance according to the present disclosure, particularly illustrating the flexible cover member in a partially open position with the flexible skin covering removed to illustrate the plurality of elongated rib members thereof.

Moreover, in another embodiment, as shown in FIG. 9, the flexible cover member 100 may also include a locking mechanism 114 for securing the flexible cover member 100 in the closed position. Referring back to FIGS. 3-6, the elasticity of the flexible skin covering 106 can also be selected such that the material allows the flexible cover member 100 to stay in a desired position, e.g., opened or closed. In still further embodiments, the flexible cover member 100 may further include one or more magnets 126 (or magnetic material) secured at various locations on the flexible cover member 100 and/or the appliance 50 to secure the cover member 100 in place. For example, as shown in FIG. 5, the appliance 50 and the cover member 100 may each include corresponding magnets 126 (or magnetic material) that can be engaged to secure the cover member 100 in the curved, open position. Similarly, as shown in FIG. 9, the locking mechanism 144 may also be equipped with magnetic material for securing the cover member 100 to the appliance 50.

Referring now to FIGS. 10-14, it should be understood that the flexible cover member 100 may be further utilized in any other suitable location (in addition to the top lid or front opening of the washing machine appliance 50) and/or may also be included with other types of appliances, such as dryer appliances. For example, in certain embodiments, it should be understood that the flexible cover member 100 described herein may be suitable for a top opening of the dryer appliance, a front opening of the dryer appliance, a drawer opening of the dryer appliance, a drawer compartment opening of the dryer appliance, and/or a lent collector opening.

Figure 10:
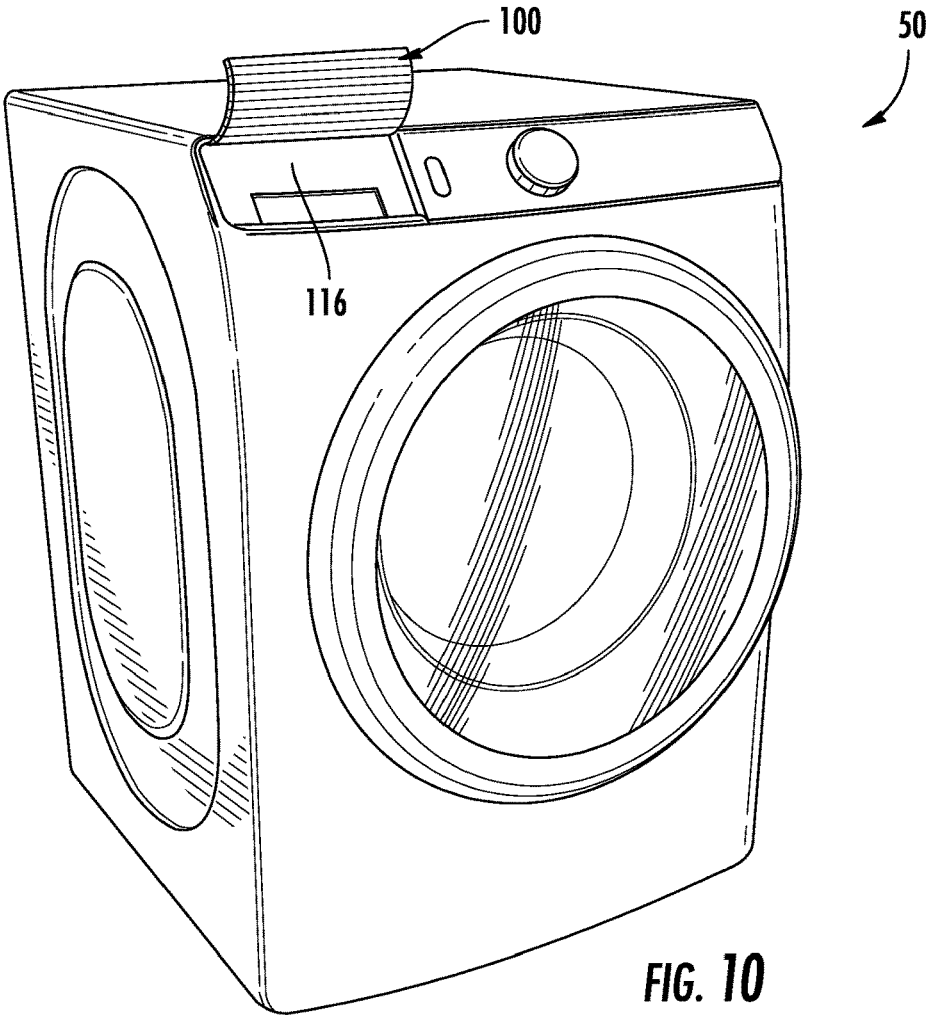
FIG. 10 provides a perspective view of an embodiment of an appliance having a flexible cover member according to the present disclosure, particularly illustrating the flexible cover member arranged with a drawer assembly of the appliance.
Figure 11:
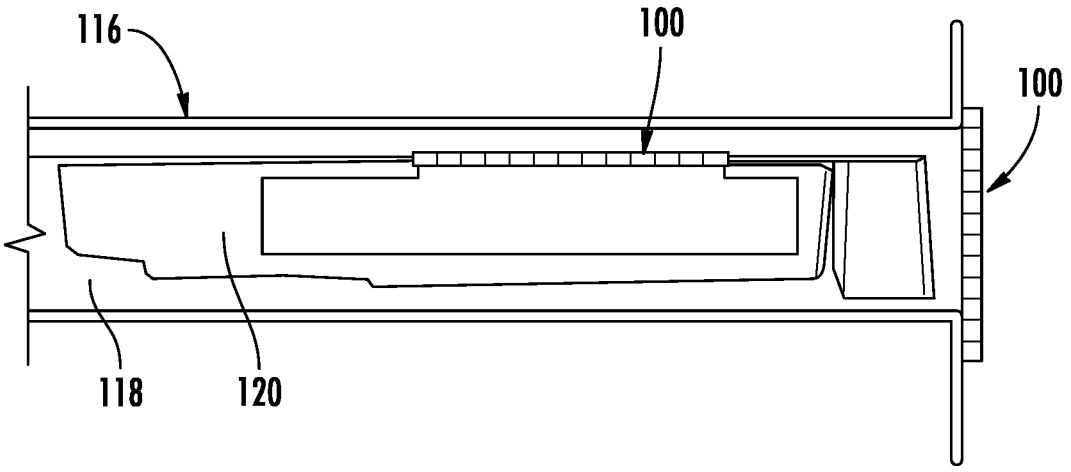
FIG. 11 provides a side view of an embodiment of a drawer assembly of an appliance having at least one flexible cover member according to the present disclosure, particularly illustrating the flexible cover member in a closed position.
Figure 12:
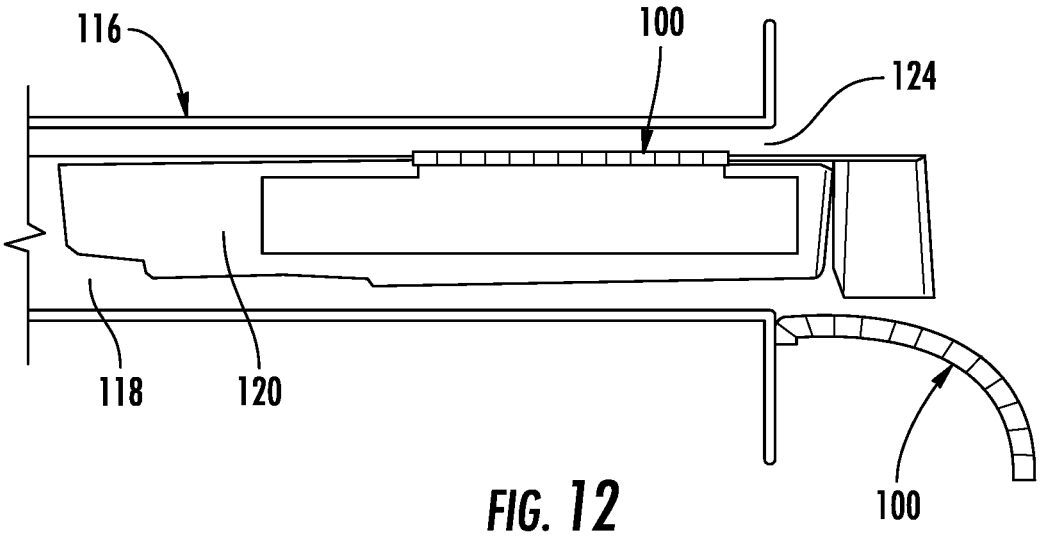
FIG. 12 provides a side view of an embodiment of a drawer assembly of an appliance having at least one flexible cover member according to the present disclosure, particularly illustrating the flexible cover member in an open position.
Figure 13:
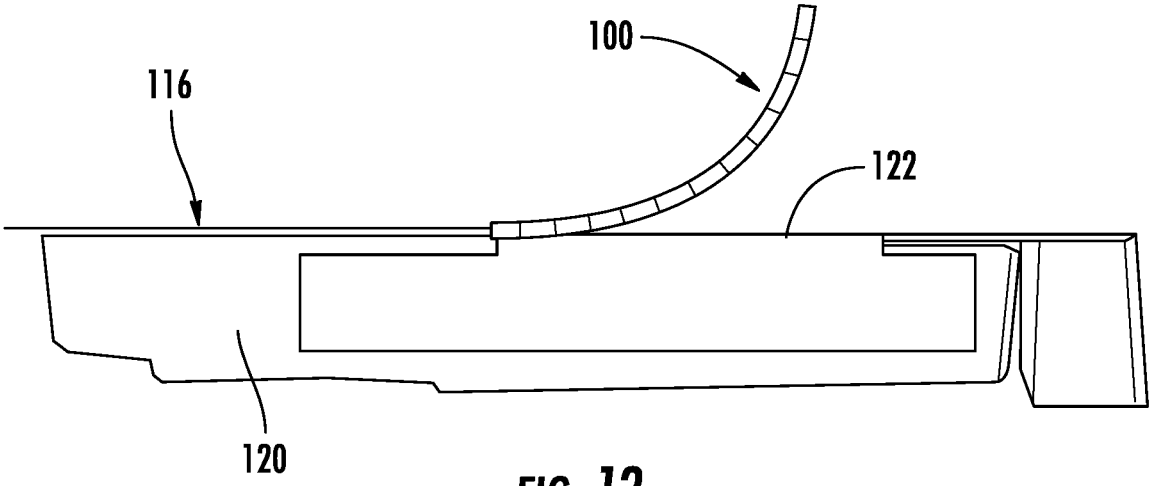
FIG. 13 provides a side view of another embodiment of a drawer assembly of an appliance having at least one flexible cover member according to the present disclosure, particularly illustrating the flexible cover member in an open position.
Figure 14:
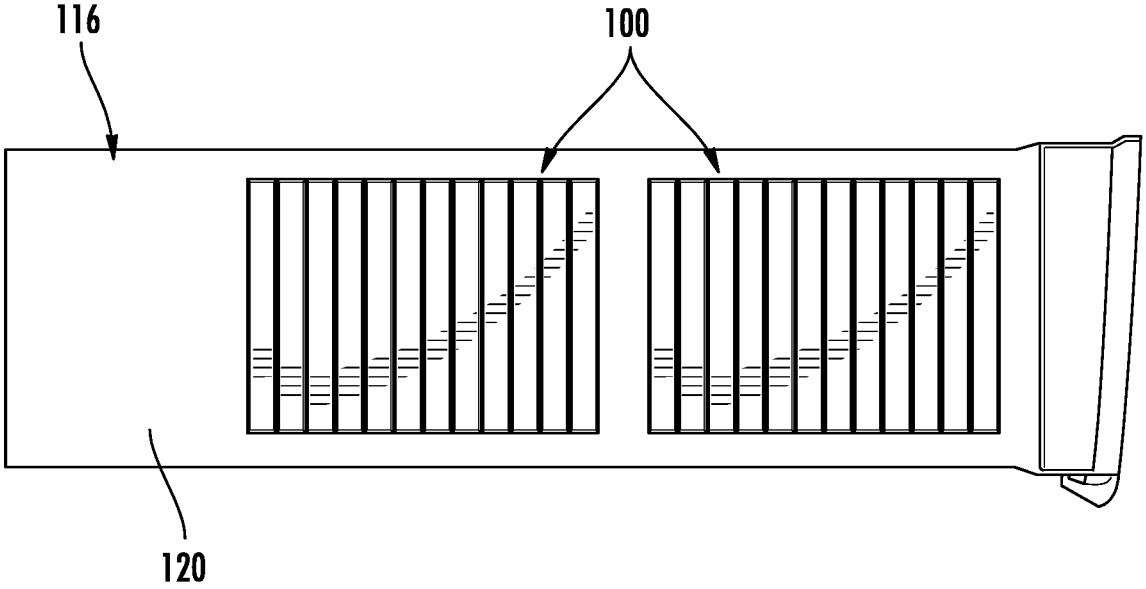
FIG. 14 provides a side view of still a further embodiment of a drawer assembly of an appliance having multiple flexible cover members according to the present disclosure, particularly illustrating the flexible cover members in a closed position.

Moreover, as shown in FIG. 10, the flexible cover member 100 may be used as a cover for a drawer assembly 116 for the washing machine appliance 50. In particular, as shown in FIGS. 11-12, the drawer assembly 116 may be part of any suitable appliance and may include a drawer 120 received within a drawer compartment or chamber 118. In such embodiments, the drawer compartment 118 may define a drawer opening 122 (e.g., see FIG. 13) or a drawer compartment opening 124 (e.g., see FIG. 12). Thus, in certain embodiments, the drawer assembly 116 may be a detergent drawer assembly configured for dispensing detergent into the tub 64 of the washing machine appliance 50. In addition, or in the alternative, the drawer assembly 116 may be a storage drawer assembly, e.g., used to house or store any other suitable appliance-related items.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

at least one chamber accessible via an opening; and a flexible cover member for providing selective access to the opening, the flexible cover member comprising a fixed, proximal end secured to the at least one chamber and a detached, distal end, the flexible cover member comprising a plurality of elongated rib members and a flexible skin covering surrounding the plurality of elongated rib members, the plurality of elongated rib members aligned in a side-by-side configuration and secured together in a spatially consecutive arrangement, wherein adjacent elongated rib members of the plurality of elongated rib members are spaced apart from each other via a gap, wherein the flexible cover member is movable between a flat, closed position that covers the opening and a curved, open position that exposes the opening by curving the detached, distal end of flexible cover member upward and away from the opening such that the detached, distal end extends exterior of the appliance, wherein each of the respective adjacent elongated rib members of the plurality of elongated rib members are secured together at respective adjoining ends via a snap fit, and wherein each of the respective adjoining ends comprises a ball joint, each of the ball joints positioned within the gap between each of the adjacent elongated rib members.

2. The appliance of claim 1, wherein the flexible skin covering is constructed of one of rubber or silicone.

3. The appliance of claim 1, wherein the flexible cover member further comprises a locking mechanism for securing the flexible cover member in the closed position.

4. The appliance of claim 1, wherein the appliance is a washing machine appliance comprising, at least, a tub, a basket rotatably mounted within the tub, and a motor in mechanical communication with the basket, the motor configured for selectively rotating the basket within the tub.

5. The appliance of claim 4, wherein the basket defines the at least one chamber for receipt of articles for washing.

6. The appliance of claim 5, wherein the opening is one of a top opening of the washing machine appliance or a front opening of the washing machine appliance.

7. The appliance of claim 4, wherein the washing machine appliance further comprises a drawer assembly defining the at least one chamber.

8. The appliance of claim 7, wherein the drawer assembly comprises at least one drawer received within a drawer compartment, wherein the opening is at least one of a drawer opening or a drawer compartment opening.

9. The appliance of claim 7, wherein the drawer assembly is a detergent drawer assembly configured for dispensing detergent into the tub, the detergent drawer assembly defining the at least one chamber for receipt of the detergent.

10. The appliance of claim 7, wherein the drawer assembly is a storage drawer assembly.

11. The appliance of claim 1, wherein the appliance is a dryer appliance.

12. The appliance of claim 11, wherein the opening is at least one of a top opening of the dryer appliance, a front opening of the dryer appliance, a drawer opening of the dryer appliance, a drawer compartment opening of the dryer appliance, or a lent collector opening.

13. A washing machine appliance, comprising:

a tub;

a basket rotatably mounted within the tub, the basket defining a chamber for receipt of articles for washing;

a valve;

a spout configured for directing fluid from the valve into the tub;

a dispenser configured for dispensing detergent into the tub;

a motor in mechanical communication with the basket, the motor configured for selectively rotating the basket within the tub; and a flexible cover member for providing selective access to the chamber, the flexible cover member comprising a fixed, proximal end secured to the at least one chamber and a detached, distal end, the flexible cover member comprising a plurality of elongated rib members and a flexible skin covering surrounding the plurality of elongated rib members, the plurality of elongated rib members aligned in a side-by-side configuration and secured together in a spatially consecutive arrangement, wherein adjacent elongated rib members of the plurality of elongated rib members are spaced apart from each other via a gap, wherein the flexible cover member is movable between a flat, closed position that covers the opening and a curved, open position that exposes the opening by curving the detached, distal end of flexible cover member upward and away from the opening such that the detached, distal end extends exterior of the appliance, wherein each of the respective adjacent elongated rib members of the plurality of elongated rib members are secured together at respective adjoining ends via a snap fit, and wherein each of the respective adjoining ends comprises a ball joint, each of the ball joints positioned within the gap between each of the adjacent elongated rib members.

14. The washing machine appliance of claim 13, wherein the flexible skin covering is constructed of one of rubber or silicone.

15. The washing machine appliance of claim 13, wherein the flexible cover member further comprises a locking mechanism for securing the flexible cover member in the closed position.

16. The washing machine appliance of claim 13, wherein the flexible cover member is positioned atop the chamber to provide selective access to the chamber or at a front location to provide selective access to the chamber.

* * * * *